United States Patent [19]

Fleischer

[11] Patent Number: 4,518,098

[45] Date of Patent: May 21, 1985

[54] COMBINATION VENDING AND SLOT MACHINE

[76] Inventor: Lane G. Fleischer, 795 Manzanita La., Reno, Nev. 89509

[21] Appl. No.: 439,268

[22] Filed: Nov. 4, 1982

[51] Int. Cl.[3] ..... G07F 17/34

[52] U.S. Cl. ..... 221/15; 194/DIG. 11

[58] Field of Search ..... 194/1 C, DIG. 11, 2, 194/3; 273/139, 142 HA; 221/15

[56] References Cited

U.S. PATENT DOCUMENTS 1,912,992 6/1933 Mills ..... 194/DIG. 11

3,561,579 2/1971 Allison ..... 194/3 X

*Primary Examiner*—Stanley H. Tollberg

*Attorney, Agent, or Firm*—Thomas M. Freiburger

[57] ABSTRACT

A vending machine in the style of a slot machine has a slot machine function, with an internal slot machine mechanism of typical construction and a series of symbol reels which display symbols through a window. When a coin is inserted in the vending machine, a vending device in the housing is activated to dispense an article from a storage hopper to an outlet, and the coin insertion is also effective to switch off an "insert coin" indicator light, switch on a "pull handle" indicator light, de-activate a normally-activated lever lock which normally prevents a slot machine handle on the housing from being pulled, and activate a coin lockout so that any further coins inserted during the operation of the machine will be rejected to a coin return. The article is vended to the dispensing outlet within a predetermined time interval after coin insertion; meanwhile the operator pulls the slot machine handle, the reels are rotated, and the slot machine mechanism successively stops the reels in the normal manner. When all reels have stopped, a limit switch de-activates the coin lockout, re-activates the handle lock, switches the "insert coin" indicator light back on and switches off the "pull handle" indicator light. The predetermined time interval for vending is longer than the time ordinarily required for a user to pull the slot machine handle and for all the symbol reels to come to a stop. Preferably the vended articles are in the form of openable capsules, so that different types of product may be dispensed within the capsules without any modification to the vending machine.

6 Claims, 7 Drawing Figures

COMBINATION VENDING AND SLOT MACHINE

BACKGROUND OF THE INVENTION

The invention relates to vending apparatus, and more particularily to a vending machine having a slot machine function for amusement, with cooperation between the two functions.

Various types of vending apparatus are well known. Also, slot machine amusement devices are well known and have appeared in various forms in territories where they are legal. In the 1920's and 1930's in the U.S., there were in use numberous slot machines which also, incidentally, dispensed a mint or candy on a non-chance basis each time a coin was inserted and the handle was pulled. However, in these machines the dispensing of the mint or other prize was merely to avert anti-gambling laws, was incidental to the gaming function of the machine, and was accomplished purely by mechanical means. The pull of the handle mechanically opened a gate to dispense the prize.

No previous vending machine has exhibited or suggested the advantageous combination of vending features and slot machine amusement function as in the present invention described below.

SUMMARY OF INVENTION

A vending machine in accordance with the principles of the present invention is styled as a slot machine and has a slot machine function without the element of chance. The machine includes a housing, with a slot machine mechanism of typical construction mounted inside the housing, including a plurality of symbol reels, with a window in the front of the housing through which the symbol reels are visible. A swingable slot machine actuator handle is mounted on the exterior of the housing and is operably connected to the slot machine mechanism such that pulling of the actuator handle is effective to actuate the slot machine mechanism, rotating the symbol reels in the normal manner. The mechanism includes a mechanism for stopping the rotation of the reels successively, in the manner of a slot machine. The housing includes a hopper at an upper location, for holding articles to be vended, with an article dispensing outlet at a lower location on the housing. There is a coin insert slot and an internal coin drop and storage area in the housing. A vending means in the housing is effective to dispense an article from the hopper to the dispensing outlet in response to insertion of a coin, including a time delay for causing the article to reach the outlet within a predetermined time interval after the coin is inserted. This time interval is longer than the time ordinarily required for a user to pull the handle and for all the symbol reels in the slot machine mechanism to be stopped so that the vended article appears to have been dispensed in response to the arrangement of symbols on the symbol reels after they have stopped.

Preferably, the vended articles are in the form of openable capsules, which may hold any of a variety of products inside.

Another preferred feature of the invention is that the vending device comprises a vending wheel at the bottom of the hopper, rotatable on a vertical axis by a motor which is activated by the insertion of the coin. The vending wheel has a plurality of openings equally angularly spaced, such that one article fits in each opening, and a partial rotation of the vending wheel is effective to drop one article down a chute which leads to the article dispensing outlet. The stoppage of the vending wheel motor may be by the sensing of the passage of the article down through the chute.

For preventing pulling of the slot machine handle except when a coin has been inserted, there is preferably included a lock lever means which normally prevents pulling of the actuator handle, but releases the handle for pulling in response to insertion of a coin, and again becomes engaged to prevent movement of the handle in response to an end of stroke function in the slot machine mechanism corresponding to the reaching of a predetermined point in the progress of the symbol reels.

In a preferred embodiment, the insertion of a coin triggers five different functions:

(1) the activation of the vending wheel motor, to initiate the vending of an article within the predetermined time interval;

(2) the activation of a coin lockout means, effective to bypass any further coins which are inserted during the vending/slot machine cycle and to drop them to a coin return;

(3) the de-activation of the lock lever device, so that the actuator handle can be pulled by the operator;

(4) the switching off of an "insert coin" indicator light; and (5) the switching on of a "pull handle" indicator light.

The end of stroke function in the slot machine mechanism preferably relates to a timing bar as typically included in conventional prior art mechanisms, the timing bar going through a stroke of motion beginning when the symbol reels are started and ending approximately when the last reel is stopped by the mechanism. Near the end of its stroke, the timing bar engages a limit switch, which preferably switches the "insert coin" indicator light back on, and re-activates the lock lever means to lock the handle against pulling. The limit switch may also be effective to switch the "pull handle" light off, although this can be accomplished by other suitable means prior to the stoppage of all reels. The engagement of the limit switch may occur prior to the end of the timing bar's stroke, just after the next-to-last reel stops. Then the last reel will stop within about one-half second after the "insert coin" light goes back on.

The cooperation of elements and functions of the vending apparatus and the slot machine apparatus in the present invention provides for an efficient, relatively inexpensive vending machine/amusement device in a manner not contemplated by the prior art. The interfacing and cooperation of the two functions causes the impression that the vended article is dispensed in response to the pattern of symbols which the user's pull of the handle has produced, yet the two functions remain somewhat independent, permitting a relatively simple assembly which is easily maintained. These and other objects, advantages, features and characteristics of the invention will be apparent from the following detailed description of a preferred embodiment, considered along with the accompanying drawings.

DESCRIPTION OF PREFERRED EMBODIMENT

Figure 1:
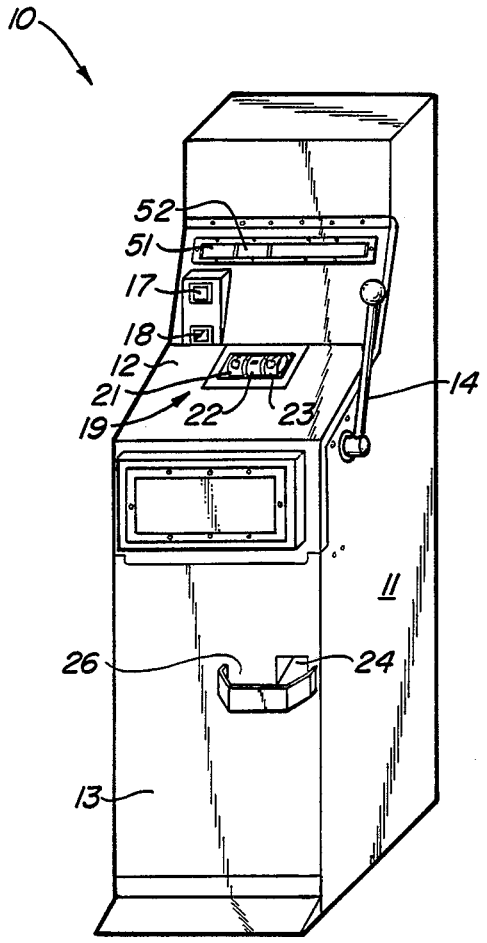
FIG. 1 is a perspective view of a vending/slot machine according to the invention.

In the drawings, FIG. 1 shows a vending machine 10 according to the invention, having a slot machine type operation for the amusement of the user. The vending machine 10 includes a housing 11 with openable outer covers 12 and 13. A slot machine actuator handle 14 is positioned on one side of the machine 10, connected to an internal slot machine mechanism as indicated at 16 in FIG. 2. The slot machine mechanism 16 may be of the type previously manufactured by Mills Bell-O-Matic (MLB) Inc. of Reno, Nev., a typical prior art mechanical slot mechanism which was in common use until about the late 1960's. Details of that mechanism are not shown in the present drawings, but key elements which interface with the vending function of the invention are indicated.

FIG. 1 also shows that the housing 11 includes a coin insert slot 17, a coin return slot 18, a window 19 through which slot machine symbol reels 21, 22, and 23 are visible as in a typical slot machine, an article dispensing outlet 24, and a catch tray 26.

Figure 2:
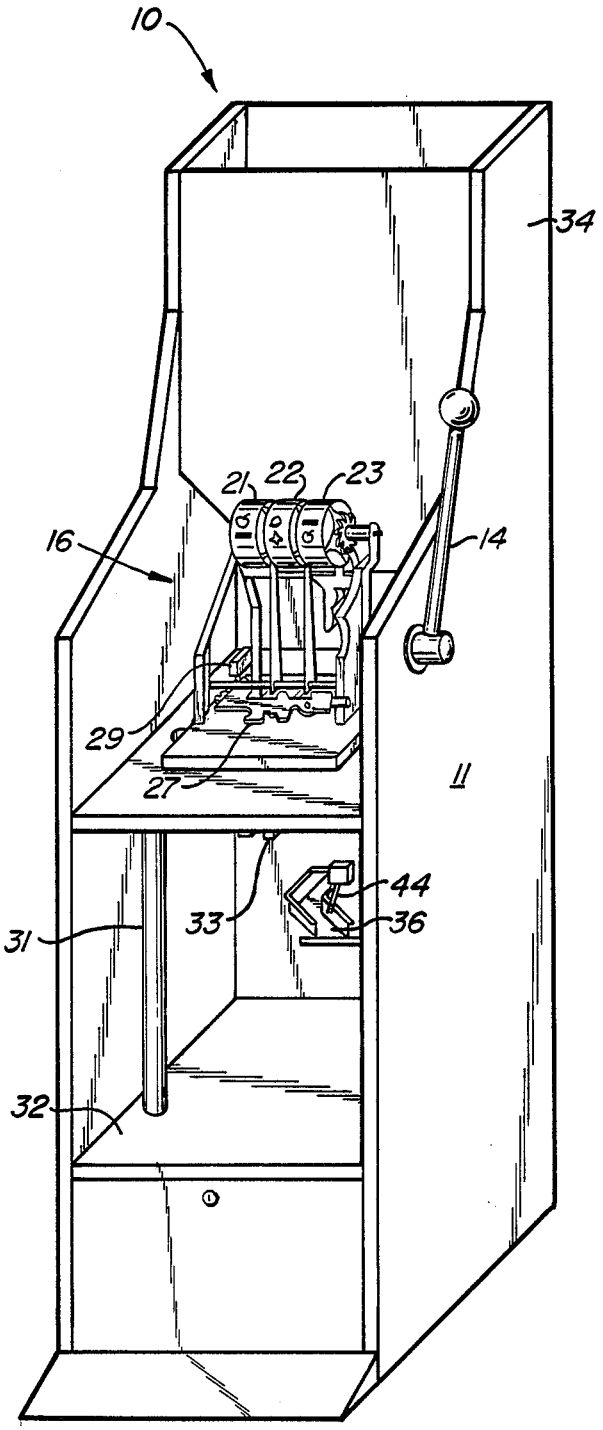
FIG. 2 is a view similar to FIG. 1 showing the machine with outer covers removed, and also showing portions of an internal slot machine mechanism removed, for clarity.
Figure 6:
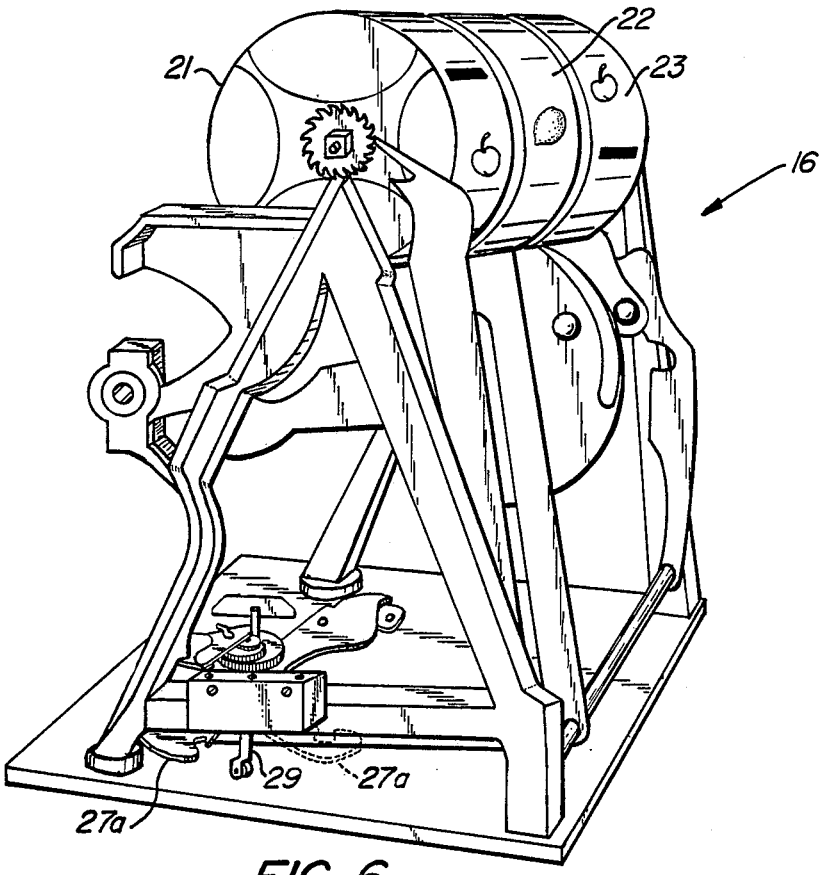
FIG. 6 is a perspective view showing key elements of a slot machine mechanism which is included as part of the combination of the present invention.

FIG. 2 shows certain key components of the vending machine 10, with the outer covers 12 and 13 removed. The handle 14 operates the slot machine mechanism 16 in the conventional manner. After a coin is inserted (coin slot 17 shown in FIG. 1), the handle 14 may be pulled down, and at the end of its stroke, the three symbol reels 21, 22, and 23 are kicked into motion by the mechanism. The handle 14 is then slowly swung back upwardly by the mechanism 16, as the symbol reels 21, 22, and 23 are successively stopped by the mechanism. At the base of the mechanism 16, as may be seen in FIGS. 2 and 6, is a timing bar 27, typical of the type of slot machine apparatus referenced above, the left end of which slowly swings toward the back as viewed in FIG. 2, to the left as viewed in FIG. 6, through the progression of the reels spinning and being stopped. The speed of this motion is controlled by a timing fan 28 shown in FIG. 6. At or near the end of the stroke of the timing bar 27, the bar engages a limit switch 29 (FIG. 6), relating to an end of stroke function described below. In FIG. 6 the bar end 27*a* is shown in the final position, after it has tripped the end of stroke limit switch 29. As the slot machine handle 14 is pulled, the bar 27 is swung to a "wound-up" position with a bar end 27*a* to the right, as indicated in dashed lines. It incidentally strikes the limit switch 27*a* in this direction also, but with no effect.

Below the slot machine mechanism 16 is a coin drop tube 31, through which coins accepted by the machine are dropped into a storage area 32, which may hold a coin box (not shown). Also seen in this area of the machine, again in reference to FIG. 2, is an article vending or dispensing unit 33 which delivers one article at a time from a hopper 34 located in the upper part of the housing 11. The articles delivered by the dispensing unit 33 drop onto an article delivery rack 36 to be fed out the article dispensing outlet 24 shown in FIG. 1.

Figure 3:
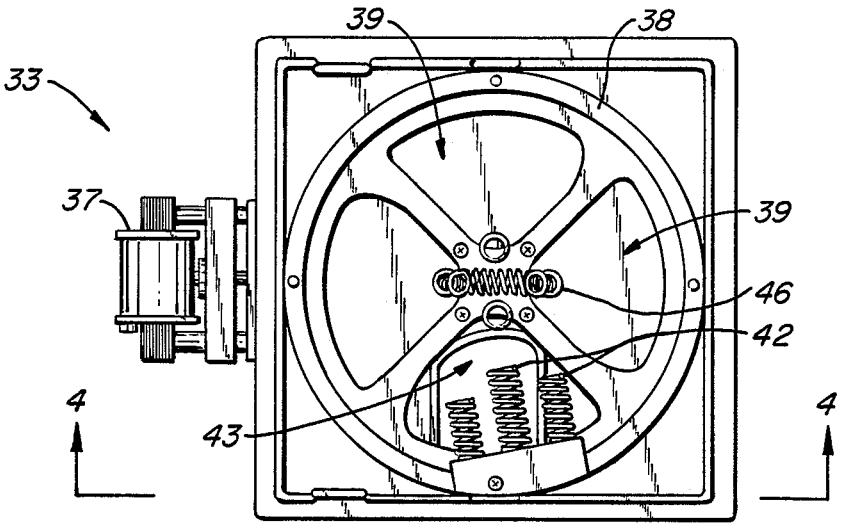
FIG. 3 is a sectional plan view showing a motorized vending wheel mechanism within the machine.
Figure 4:
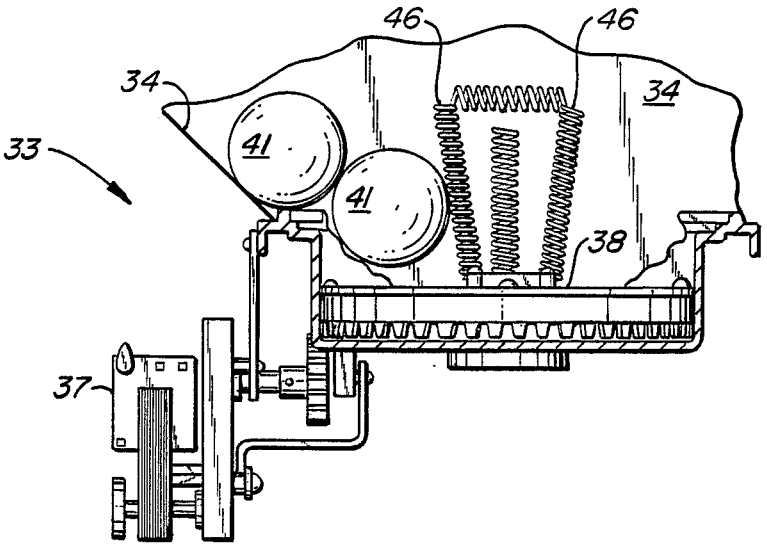
FIG. 4 is a sectional view in elevation of a portion of an article storage hopper and the vending wheel mechanism of FIG. 3, as viewed along the line 4—4 in FIG. 3.

FIGS. 3 and 4 show in plan and in elevational section, respectively, the article dispensing unit 33 located at the bottom of the hopper 34. The unit 33 includes a motor 37 which is gear-reduced to operate a dispensing wheel 38 at a relatively slow speed, e.g. 10 rpm. The dispensing wheel 38 has a plurality of openings 39 as shown in FIG. 3, each of which is large enough to receive only one article 41 stored in the hopper above. A set of horizontal springs 42, fixedly mounted with respect to the hopper 34, extend just above the dispensing wheel 38, and over an opening or chute 43 below, leading down to the article dispensing outlet 24. Thus, when the wheel is in the position shown in FIG. 3, articles cannot fall through to the chute 43 below, but one article ordinarily occupies each of the other three wheel openings 39. Then, when the motor rotates the wheel 38, an article in the next adjacent wheel opening 39 is brought into position over the chute 43 and under the horizontal springs 42, and dropped into the chute. Preferably the motor 37, which has been activated by the insertion of a coin into the slot, is shut off by an end of vend limit switch 44 which may be positioned in the chute 43, but is preferably located at the dispensing rack 36, as shown in FIG. 2. This limit switch 44 senses that an article has been dispensed.

The vending wheel 38 may include vertically mounted springs 46 which rotate with the wheel and stir up the articles in the hopper so that they properly fill the wheel openings 39 as the wheel turns.

If the dispensing wheel is set to rotate at about 10 rpm as mentioned above, the total time from insertion of the coin to the dispensing of an article and the tripping of the limit switch 44 may be about four seconds to five and a half seconds.

Figure 5:
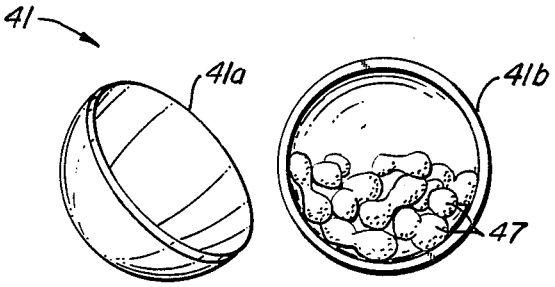
FIG. 5 is a perspective view showing an openable capsule for holding the products to be vended, which may be the form in which the products are retained in the machine's hopper and dispensed.

The articles 41 stored in the hopper 34 and dispensed preferably are openable capsules as shown in FIG. 5, made up of two separable components 41*a* and 41*b* which form a sphere, egg-shape or other shape when closed. In this way, any form of product 47 may be dispensed from the vending machine 10, with uniform-sized capsules 41, so that the product may be varied without changing any of the physical structure of the vending machine 10.

Figure 7:
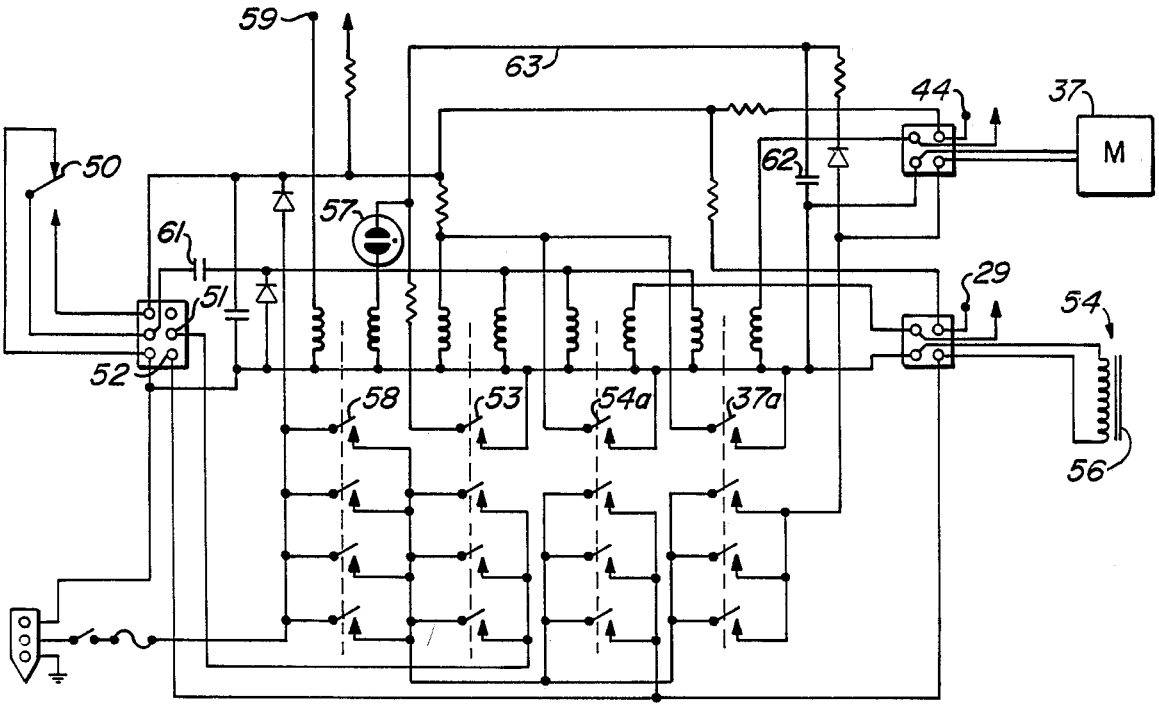
FIG. 7 is a circuit diagram indicating the various functions of the vending machine.

In operation, the circuitry of the vending machine 10 is shown schematically in FIG. 7, and the operation of the machine will now be described in reference thereto. When a coin is inserted in the coin slot 17, this makes momentary contact at a coin switch 50, the normal position of which is shown in FIG. 7. This causes five things to occur: (1) an "insert coin" indicator light 51 shown in FIG. 1, which is normally on, is switched off (FIG. 7 indicates a contact which leads to the indicator light); (2) a "pull handle" indicator light 52, which is normally off, is switched on; (3) a coin lockout device of a type typically found in vending machines is de-energized to activate it to cause the bypassing of any further coins to the coin return 18, via coin/lockout relay 53 indicated in FIG. 7; (4) a handle lock device 54, which normally locks the handle against pulling, is energized by a relay 54*a* to de-activate, thereby permitting the handle to be pulled; and (5) the vending motor 37 is energized via a relay 37*a* to rotate the dispensing wheel 38 as described above.

When the user sees the "pull handle" indicator light on, he pulls the handle 15 of the slot machine mechanism 16, causing the vending reels 21, 22, and 23 to rotate and the timing bar 27 to move through its return stroke as described above.

As the timing bar approaches the end of its stroke, the end of stroke limit switch 29 is engaged and this may occur just after the next to the last reel comes to a stop. The engagement of this limit switch causes four things to occur, provided the end of vend switch 44 has also been tripped: (1) the "insert coin" indicator light 51 is switched back on; (2) the coin lockout device 53 is re-energized and de-activated, to permit the insertion of another coin; (3) the "pull handle" indicator light is switched off; and (4) the handle lock device 54 is de-energized to re-activate the lock, so that no further pulling of the handle can occur until another coin is inserted. As indicated in the schematic diagram of FIG. 7 the handle lock device may comprise a reciprocable pin 56 which engages the handle mechanism normally, e.g. under the influence of a spring, to normally lock the handle. When the handle solenoid is energized the pin 56 retracts to permit pulling of the handle.

Meanwhile, the vending mechanism is in the process of dispensing an article from the hopper to the dispensing outlet 24. In the path of the article is the end of vend limit switch 44, which may be positioned in the dispensing rack as indicated in FIG. 2. The end of vend switch 44 causes the vending motor 37 to stop. As discussed above, this normally occurs just after the last symbol reel comes to a stop, giving the impression that the article is dispensed in response to the configuration of symbols which have resulted from the pull of the handle. The tripping of the end of vend switch 44 is also required for the "insert coin" light to go on and for the coin lockout to be re-energized and de-activated. Only when both the limit switches 29 and 44 have been tripped can this occur.

As indicated in FIG. 7, both of the latching relays 37*a* and 54*a*, for the vend motor and the handle lock solenoid, respectively, must have been shifted to the "off", open-switch position for the coin/lockout latching relay 53 to be energized and shifted back to the "on" position wherein the "insert coin" indicator is on and the coin lockout is energized to de-activate it, permitting the insertion of another coin. As is also clear from FIG. 7, the handle solenoid relay 54*a* in this preferred embodiment operates switches for both the handle solenoid 54 and the "pull handle" indicator light 52, so that both are de-energized simultaneously by the end of stroke function, re-activating the spring-biased handle lock and shutting off the indicator light 52.

As also indicated in FIG. 7, the circuitry preferably includes an electronic delay timer 57 which puts an approximately ten second limit on the operation of the vending cycle. That is, if the end of vend limit switch 44 has not signaled that an article has been dispensed within about ten seconds after the coin is inserted, the timer 57 is effective to shut down the entire machine, via an out-of-order relay 58, which shuts off power to the remaining circuits. If this occurs, a reset switch 59 within the machine must be operated to shift the out-of-order relay 58 back to the "on" position, to reset the machine.

In the normal position of the various circuits in FIG. 7, prior to the insertion of a coin, the four latching relays are set as follows: the out-of-order relay 58 is in the "on", closed position, so that power is connected to the other switches; the coin/lockout relay 53 is also closed; and the other relays 54*a* and 37*a* are both open. When a coin is inserted, the coin switch 50 makes instantaneous contact and sends a pulse to a capacitor 61, which sets three of the relays. The out-of-order 58 is not affected, but the other three shift—the coin/lockout relay 53 is opened, to the "off" position, turning off the "insert coin" light and activating the coin lockout; the handle solenoid relay 54*a* and the vend motor relay 37*a* are closed, to the "on" position, energizing the handle solenoid 54 to de-activate it and unlock the handle, and starting the vend motor 37.

As long as there is power to the vend motor, a capacitor 62 is being charged. If the end of vend switch 44 is not engaged within about ten seconds, voltage in the upper line 63 becomes high enough to flash a neon bulb serving as the timer 57, shifting the out-of-order relay 58 to "off" and shutting down power to the rest of the machine.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A vending machine in the style of a slot machine and having at least in part a slot machine function, comprising:

a housing;

a slot machine mechanism mounted inside the housing, including a plurality of symbol reels, with a window in the front of the housing through which the symbol reels are visible;

a swingable slot machine actuator handle on the exterior of the housing, operably connected to the slot machine mechanism such that pulling of the actuator handle is effective to actuate the slot machine mechanism, rotating the symbol reels in the manner of a slot machine;

means associated with the slot machine mechanism for successively stopping the rotation of the reels;

a hopper at an upper location in the housing for articles to be vended, an article dispensing outlet at a lower location on the housing, a coin insert slot and a coin drop area in the housing; and vending means in the housing for dispensing an article from the hopper to the dispensing outlet in response to insertion of a coin, including timing means for causing the article to reach the outlet within a predetermined time interval after the coin is inserted, the vending means comprising a vending wheel mounted at the bottom of the hopper for rotation about a vertical axis and having a plurality of openings equally angularly spaced on the wheel for passing one article from the hopper at a time, a chute positioned just below the vending wheel such that a partial rotation of the wheel will bring a single article over the chute, permitting it to drop, with means for blocking further articles from dropping, a motor for rotating the vending wheel, and means for activating the motor in response to the insertion of a coin;

said predetermined time interval being longer than the time ordinarily required for a user to pull the handle and for all the symbol reels in the slot machine mechanism to stop.

2. The vending machine of claim 1, further including means for stopping the motor's rotation in response to the passage of an article down through the chute.

3. The vending machine of claim 1, wherein the vended articles comprise openable capsules with products inside.

4. A vending machine having a slot machine mechanism with a plurality of rotatable symbol reels displaying symbols through a window at the front of the vending machine, comprising:

a housing, with the slot machine mechanism mounted inside;

a swingable slot machine handle on the exterior of the housing, operably connected to the slot machine mechanism such that pulling of the handle is effective to actuate the mechanism, rotating the symbol reels, and the mechanism including means for stopping the reels in the manner of a slot machine;

a hopper at an upper location in the housing for articles to be vended, an article dispensing outlet at a lower location on the housing, a coin insert slot and a coin drop area in the housing; and vending means in the housing for dispensing an article from the hopper to the dispensing outlet in response to insertion of a coin;

a normally-on "insert coin" indicator light and a normally-off "pull handle" indicator light on the housing;

coin lockout means for bypassing inserted coins to a coin return when the coin lockout means is activated;

normally-activated lock lever means for preventing pulling of the actuator handle;

means for activating the coin lockout means, switching off the "insert coin" light, switching on the "pull handle" light and de-activating the lock lever means in response to insertion of a coin, so that the user can pull the slot machine handle to rotate the symbol reels; and means for de-activating the coin lockout means, switching on the "insert coin" light and re-activating the lock lever means in response to the dispensing of an article and the reaching of a predetermined point in the rotation and stoppage of the symbol reels by the slot machine mechanism.

5. The vending machine of claim 4, wherein the vended articles comprise openable capsules with products inside.

6. The vending machine of claim 4, wherein the vending means comprises a vending wheel mounted at the bottom of the hopper for rotation about a vertical axis and having a plurality of openings equally angularly spaced on the wheel for passing one article from the hopper at a time, a chute positioned just below the vending wheel such that a partial rotation of the wheel will bring a single article over the chute, permitting it to drop, with means for blocking further articles from dropping, a motor for rotating the vending wheel, and means for activating the motor in response to the insertion of a coin.

* * * * *